US007532126B2

(12) United States Patent
Young et al.

(10) Patent No.: US 7,532,126 B2
(45) Date of Patent: May 12, 2009

(54) REMOTE HOMECARE MONITORING SYSTEM AND METHOD THEREOF

(75) Inventors: Shuenn-Tsong Young, Taipei (TW); Chung-Wang Lee, Hsinchu (TW); Woei-Chyn Chu, Taipei (TW); Yin-Jiun Tseng, Sijhih (TW)

(73) Assignee: National Yang-Ming University, Taipei (TW)

( * ) Notice: Subject to any disclaimer, the term of this patent is extended or adjusted under 35 U.S.C. 154(b) by 321 days.

(21) Appl. No.: 11/640,855

(22) Filed: Dec. 19, 2006

(65) Prior Publication Data

US 2008/0143538 A1 Jun. 19, 2008

(51) Int. Cl.
*G08B 23/00* (2006.01)

(52) U.S. Cl. ..... 340/573.1; 340/573.4; 600/300

(58) Field of Classification Search ..... 340/573.1, 340/573.4, 539.14, 539.15; 348/155, 169; 382/103, 107; 600/300, 301; 705/2
See application file for complete search history.

(56) References Cited

U.S. PATENT DOCUMENTS 5,544,649 A * 8/1996 David et al. ..... 600/301
5,868,669 A * 2/1999 Iliff ..... 600/300
6,168,563 B1 * 1/2001 Brown ..... 600/301
6,368,273 B1 * 4/2002 Brown ..... 600/300
6,611,206 B2 * 8/2003 Eshelman et al. ..... 340/573.1
6,614,348 B2 * 9/2003 Ciccolo et al. ..... 340/573.4
6,816,603 B2 * 11/2004 David et al. ..... 382/107
6,972,677 B2 * 12/2005 Coulthard ..... 340/539.15
7,110,569 B2 * 9/2006 Brodsky et al. ..... 382/103
7,369,680 B2 * 5/2008 Trajkovic et al. ..... 382/103
2007/0076095 A1 * 4/2007 Tomaszewski ..... 348/155
2007/0130287 A1 * 6/2007 Kumar et al. ..... 709/217
2007/0291991 A1 * 12/2007 Otsu et al. ..... 382/104
2008/0004906 A1 * 1/2008 Klass et al. ..... 705/2
2008/0214949 A1 * 9/2008 Stivoric et al. ..... 600/549

* cited by examiner

*Primary Examiner*—John A Tweel, Jr.
(74) *Attorney, Agent, or Firm*—Bacon & Thomas, PLLC

(57) ABSTRACT

The present invention discloses a remote homecare monitoring system that includes a behavior detector, an image capture device, and a gateway. The behavior detector detects an abnormal activity behavior, and the image capture device captures image data of a user's condition, and the gateway transmits the images to a computer of a related unit or a telephone of a related contact person, so that the related unit or contact person can know about the user's activity behavior within a time before or after the occurrence of the abnormal behavior quickly from the image data, and medical professionals can timely provide appropriate medical treatments.

7 Claims, 3 Drawing Sheets

REMOTE HOMECARE MONITORING SYSTEM AND METHOD THEREOF

FIELD OF THE INVENTION

The present invention relates to a remote homecare monitoring system and method thereof, and more particularly to a system and a method that detect a care receiver's abnormal activity behavior and capture image data of the care receiver's condition and transmit the images to a computer of a related unit or a telephone of a related contact person via a gateway, so that designated personnel, such as medical professionals, can timely provide appropriate reactions, or medical treatments.

BACKGROUND OF THE INVENTION

As medical science is well developed, medical services and hygiene are enhanced, and the world's average fertility rate is dropped gradually, our health condition and average life expectancy are improved significantly, and thus our population tends to be an aging population. In the aging population, related issues of medical services and social welfares for aging and chronic diseases arise. To cope with this trend and satisfy the patient requirement for a healthcare service at home, the market demand of healthcare and remote homecare for elderly people and patients (hereinafter referred to as "care receivers") becomes increasingly higher.

In recent years, information technology keeps advancing, the applications of remote homecare and medical service become more diversified, and many developed countries aggressively conduct research and promotions on remote homecare and medical service to solve the problems caused by the elderly population. These activities not only help medical institutes including hospitals or clinics to achieve the purposes of sharing resources and saving costs, but also effectively promote homecare and medical services to remote districts with insufficient medical resources.

In general, the main function of the so-called "remote homecare" or "remote medical service" is to assist monitoring the health condition of a care receiver by obtaining and analyzing the care receiver's physiological parameters, and provide medical services and treatments at the most appropriate time. Remote homecare or remote medical service connects a care receiver and a family member, or a care receiver and a doctor at two different places and transmits information such as the care receiver's physiological parameters (including blood pressure, heartbeat or blood sugar level) to a family member or a doctor through the Internet or telephone network technology, so as to determine the care receiver's current conditions to provide timely homecare or medical service when the care receiver is unwell or in a critical condition.

However, remote homecare is provided to notice the care receiver's family member(s) or doctor via Internet or telephone technologies only after the care receiver's physiological parameters indicate an abnormal physiological condition. Although the care receiver's family member(s) or doctor can obtain the information of the care receiver's physiological conditions from the physiological parameters, they cannot know about the information on the care receiver's activity behaviors occurred before the abnormal physiological condition actually occurs from the physiological parameters, and the activity behaviors are usually important for a doctor's diagnosis. For example, a care receiver becomes unconscious after the abnormal physiological condition occurs, and the care receiver walks clumsily at home and hits his/her head and finally passes out on the floor. In another example, a care receiver has an external contusion or bone fracture after the care receiver passes out in a walk. However, remote homecare only can send the physiological parameters related to the abnormal physiological conditions to a doctor, but the care receiver's activity behavior including a hit on his/her head, an external contusion, or a bone fracture cannot be reported to the doctor.

In general, a remote medical service usually measures a care receiver's physiological parameters by various types of detection instruments, and sends the physiological parameters to a doctor's computer via Internet. The exchanging pictures of the care receiver and the doctor are taken by a webcam and sent to the computers of the doctor and the care receiver via Internet. The content of conversations between the care receiver and the doctor is transmitted by a network voice transceiver to the computer of the doctor and the care receiver via Internet. Therefore, the doctor can perform a diagnosis for the care receiver based on the physiological parameters, the pictures of the care receiver and the content of the conversation. However, the remote medical service is conducted while a conscious care receiver is having a conversation with the doctor. If the care receiver is at an unconscious condition, the care receiver is unable to initiate the remote medical service, and thus the remote medical service for such care receivers has its blind spot of application. As to an unconscious care receiver, the remote medical service provides no help at all.

Therefore, it is an important subject for researchers and manufacturers to find a way of using the existing low-price broadband network and very low equipment cost to design a remote home monitoring system and a method to overcome the shortcomings of the remote homecare or remote medical services. Particularly, if the activity behaviors of a care receiver can be recorded before and after the care receiver becomes unconscious for a quick review, it will be very helpful for doctors to perform diagnosis.

SUMMARY OF THE INVENTION

In view of the shortcomings of the prior art, the inventor of the present invention based on years of experience to conduct extensive research and experiments, and finally invented a remote homecare monitoring system and its method in hope of contributing such innovative idea to the general public.

Therefore, it is a primary objective of the present invention to provide a remote homecare monitoring system comprising: a behavior detector for sending out wireless information containing a behavior parameter, a source identification code, and a behavior time corresponding to the behavior parameter; an image capture device for sending out video information such as an image data, an imaging apparatus number and a shooting time corresponding to the image data; and a gateway for storing a network apparatus number, a filter time, a monitoring range threshold value and a location data corresponding to the source identification code, and receiving the wireless information, and storing the video information into a first storage area. If the gateway determines that the behavior parameter contained in the wireless information does not lie within a monitoring range threshold value, then it indicates that there is an abnormal activity behavior, and a filter starting time and a filter ending time are found, and the filter time uses the behavior time corresponding to the behavior parameter as the center to find all image data in the video information corresponding to the filter starting time and the filter ending time. All image data within the filter time in the first storage area are stored in a second storage area of the gateway, and the location data corresponding to the source identification code contained in the wireless information and the source identification code and the network apparatus number contained in the wireless information are packed into a warning message. The warning message corresponding to the location data is sent to a management server, such that when the management server receives the warning message, the contact information of a related unit or a contact person registered on the management server by the user can be found from the source identification code of the warning message and reported to a computer or a mobile phone of the related unit or related contact person via network. If the computer or mobile phone of the related unit or related contact person is connected to the gateway through network, users can browse the image data in the second storage area, and the related unit or related contact person can know about a care receiver's activity behavior within a period of time (which is the filter time) before or after the occurrence of the abnormal behavior quickly from the image data in the second storage area.

Another objective of the present invention is to provide a remote homecare monitoring method that is applied in a remote homecare monitoring system, and the remote homecare monitoring system includes a gateway, a behavior detector and an image capture device. The gateway continuously receives video information outputted from the image capture device and saves the video information in a first storage area of the gateway. If the wireless information outputted from the behavior detector is received and the gateway determines that a behavior parameter contained in the wireless information does not lie within a monitoring range threshold value of the gateway, a filter time of the gateway uses a behavior time corresponding to the behavior parameter as a center to find a filter starting time and a filter ending time, as well as all image data in the video information and corresponding to the filter time from the filter starting time to the filter ending time, and saves the image data in the filter time into a second storage area of the gateway, and pack a location data corresponding to a management server in the gateway, a source identification code in the wireless information, and a network apparatus number of the gateway into a warning message, and sends the warning message to the management server. After the management server receives the warning message, the source identification code of the warning message is used to locate a user who wears the behavior detector from the contact information of a related unit or contact person logged on the management server, and notice a computer of a related unit or telephone of a contact person based on the contact data via a network, such that when the computer of a related unit or the telephone of a contact person is connected to the gateway via a network, the computer of the related unit or the telephone of the contact person can read the image data of the care receiver before and after the occurrence of an abnormal activity behavior directly from the second storage area, so as to assist the related unit or contact person to know about the care receiver's condition before and after the occurrence of the abnormal activity behavior.

To make it easier for our examiner to understand the objective, technical characteristics and performance of the present invention, preferred embodiments accompanied with related drawings are used for illustrating the present invention as follows.

DETAILED DESCRIPTION OF THE PREFERRED EMBODIMENTS

Figure 1:
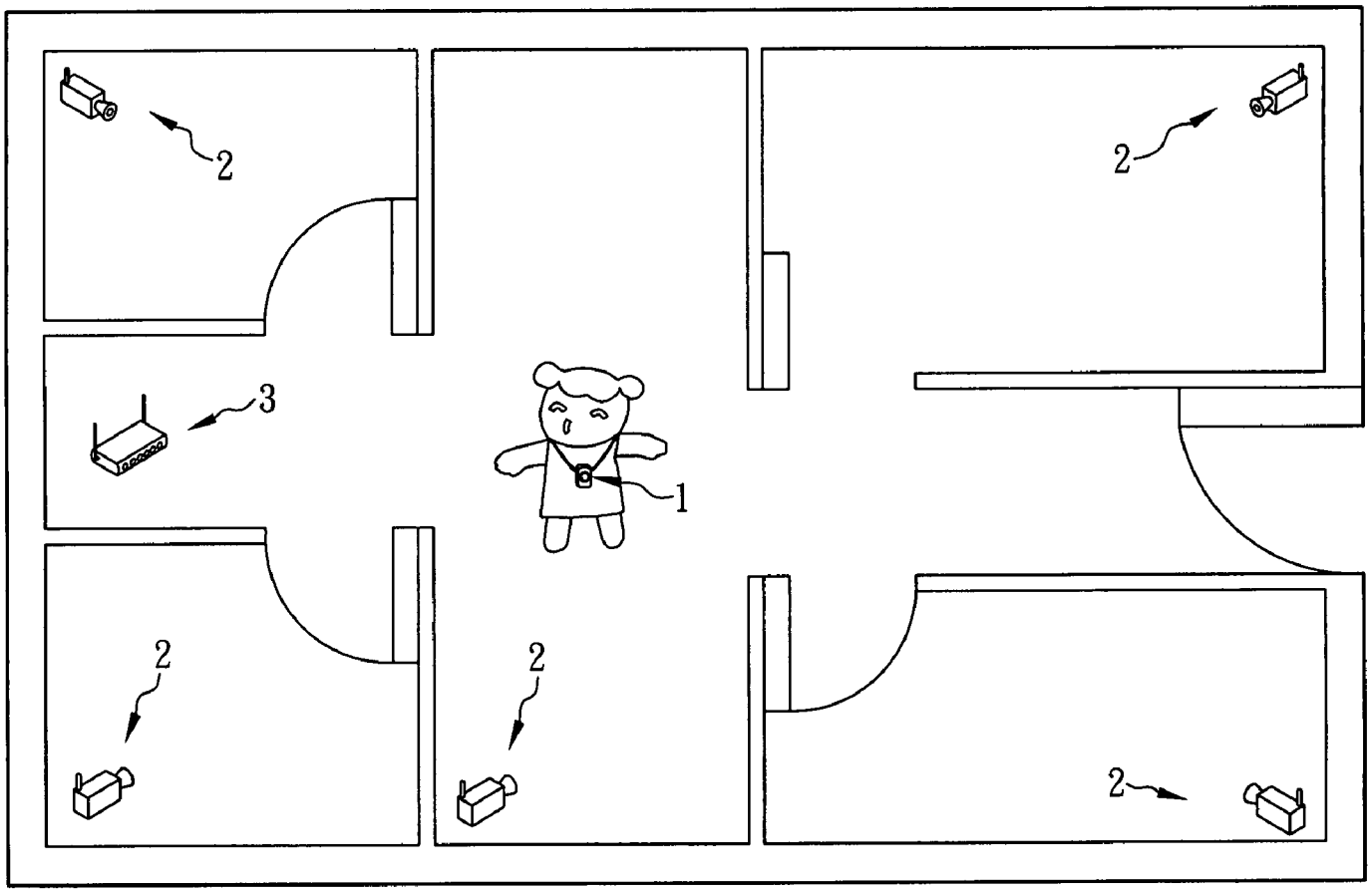
FIG. 1 is a schematic view of installing a gateway, a behavior detector and an image capture device in a monitoring environment of the present invention.
Figure 1:
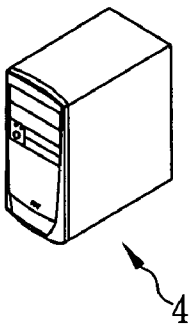
Figure 2:
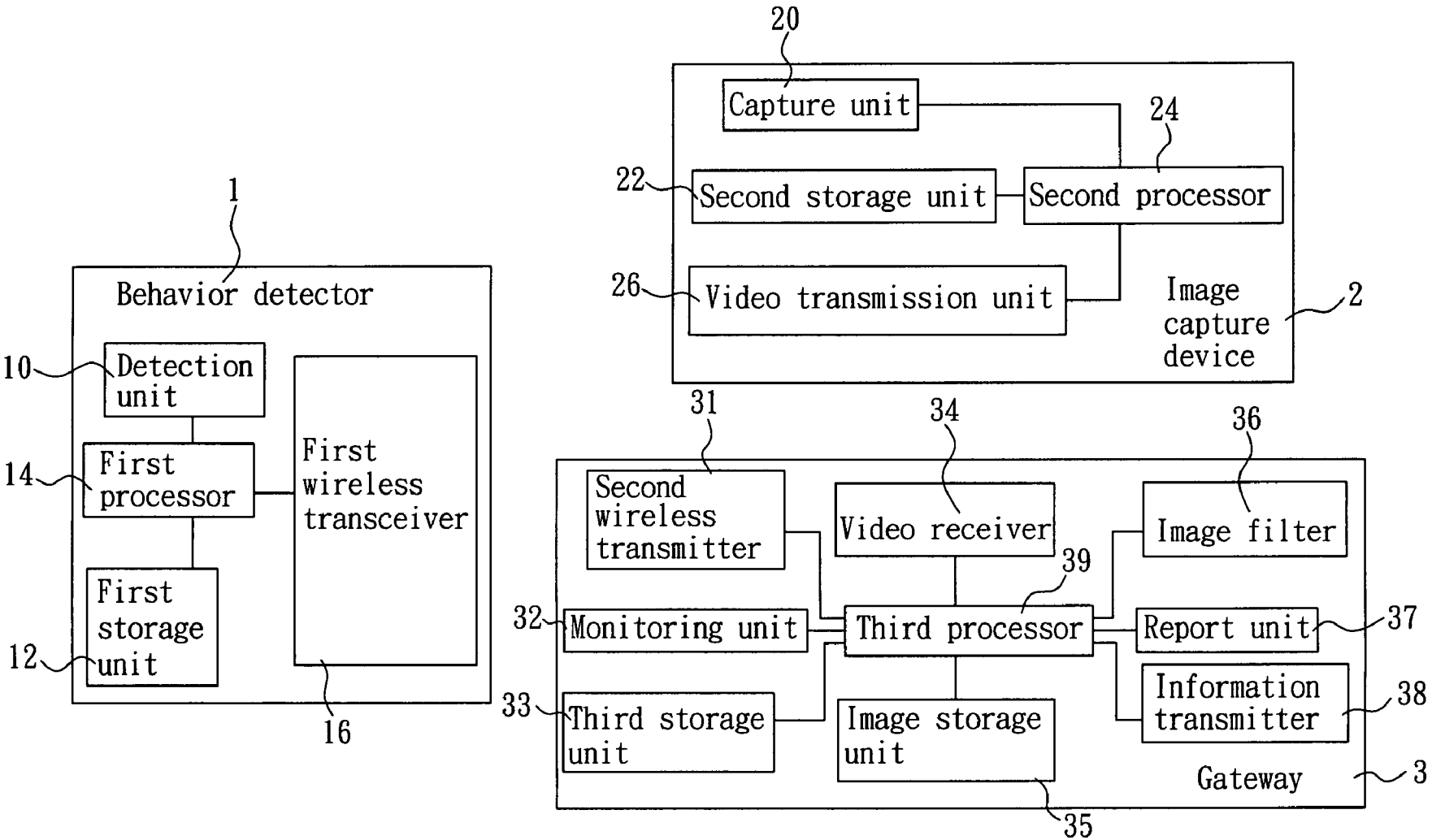
FIG. 2 is a schematic view of the architecture of a gateway, a behavior detector and an image capture device of the present invention.

Referring to FIGS. 1 and 2 for a remote homecare monitoring system and its method in accordance with the present invention, the system comprises at least one behavior detector 1 worn on the body of a user (such as the aforementioned care receiver), and the behavior detector 1 comprises a detection unit 10 such as an accelerometer, a first storage unit 12, a first processor 14 and a first wireless transceiver 16, wherein the detection unit 10 detects a user's activity behavior (such as walking, jogging or falling) and produces a behavior parameter, and the first storage unit 12 saves a source identification (ID) code (which is an exclusive personal identification code of a user), and the first processor 14 sends the behavior parameter, the source identification code and the behavior time corresponding to the behavior parameter to the first wireless transceiver 16, and the first wireless transceiver 16 packs the behavior parameter, the source identification code and the behavior time into a wireless information, and sends the wireless information to an external monitoring environment (such as home) of the behavior detector 1.

The system further comprises at least one image capture device 2 installed at different monitoring areas (such as bedroom or dining room) in the monitoring environment and the image capture device 2 comprises a capture unit 20, a second storage unit 22, a second processor 24 and a video transmission unit 26, wherein the capture unit 20 is provided for capturing an image data (such as a video stream or a photo) of a scene in the monitoring area, and the second storage unit 22 stores an imaging apparatus number (such as a serial number set by the user or a product number), and the second processor 24 sends the image data, the imaging apparatus number and the shooting time corresponding to the image data to the video transmission unit 26, and the video transmission unit 26 packs the image data, the imaging apparatus number and the shooting time into video information, and sends out the video information.

The system further comprises a gateway 3 installed in the monitoring environment, and the gateway 3 comprises a second wireless transmitter 31, a monitoring unit 32, a third storage unit 33, a video receiver 34, a third processor 39, an image storage unit 35, an image filter 36, a report unit 37 and an information transmitter 38, wherein the second wireless transmitter 31 receives the wireless information, and the monitoring unit 32 stores a predetermined monitoring range threshold value, and the third storage unit 33 stores a network apparatus number (such as a MAC addressor or an IP address), and the video receiver 34 receives the video information, and the image storage unit 35 includes a first storage area and a second storage area, and the image filter 36 has a filter time, and the report unit 37 includes at least one location data (such as an IP location) of the management server 4, and each location data corresponds to a source identification code.

The third processor 39 continuously saves the video information into the first storage area. If the first storage area of the third processor 39 is filled up with video information, the video information at the earliest shooting time will be deleted first, and then the currently received video information will be saved into the first storage area, but the foregoing storage technology is a prior art, and thus will not be described here.

Further, the third processor 39 determines whether the behavior parameter contained in the wireless information does not lie within the monitoring range threshold value; if it is determined that the behavior parameter contained in the wireless information does not lie within the monitoring range threshold value, the third processor 39 will retrieve a behavior time contained in the wireless information, and the filter time will be added to or subtracted from the behavior time in the wireless information to produce a filter time, and the shooting time contained in the video information will be found from the first storage area, and the image data contained in the filter time will be found and saved into the second storage area. The third processor 39 finds a location data corresponding to a source identification code in the wireless information from the report unit 37, and sends the source identification code and the network apparatus number corresponding to the location data in the wireless information to the information transmitter 38, and the information transmitter 38 packs the corresponding location data, the source identification code contained in the wireless information, and the network apparatus number into a warning message, and sends the warning message to a management server 4 corresponding to the location data.

With the structure of the foregoing components, if the monitoring range threshold value is set for the behavior parameter (such as an inclination and an acceleration of a user's fall) and the user actually falls, the gateway 3 will determine whether or not the behavior parameter lies within the monitoring range threshold value, and send a warning message to the management server 4. By then, the management server 4 will notice a computer of a related unit or a telephone of a related contact person corresponding to the source identification code registered on the management server 4 by the user based on the source identification code of the warning message, such that if the related unit or related contact person is connected to the gateway 3 via network (Internet or telephone network), the image data within the filter time can be obtained from the second storage area. The related unit or related contact person no longer needs to blindly search for the image data indicating when the user's abnormal activity occurred from the first storage area, so as to quickly know about the user's condition and facilitate a medical unit to provide the most appropriate medical treatment.

Figure 3:
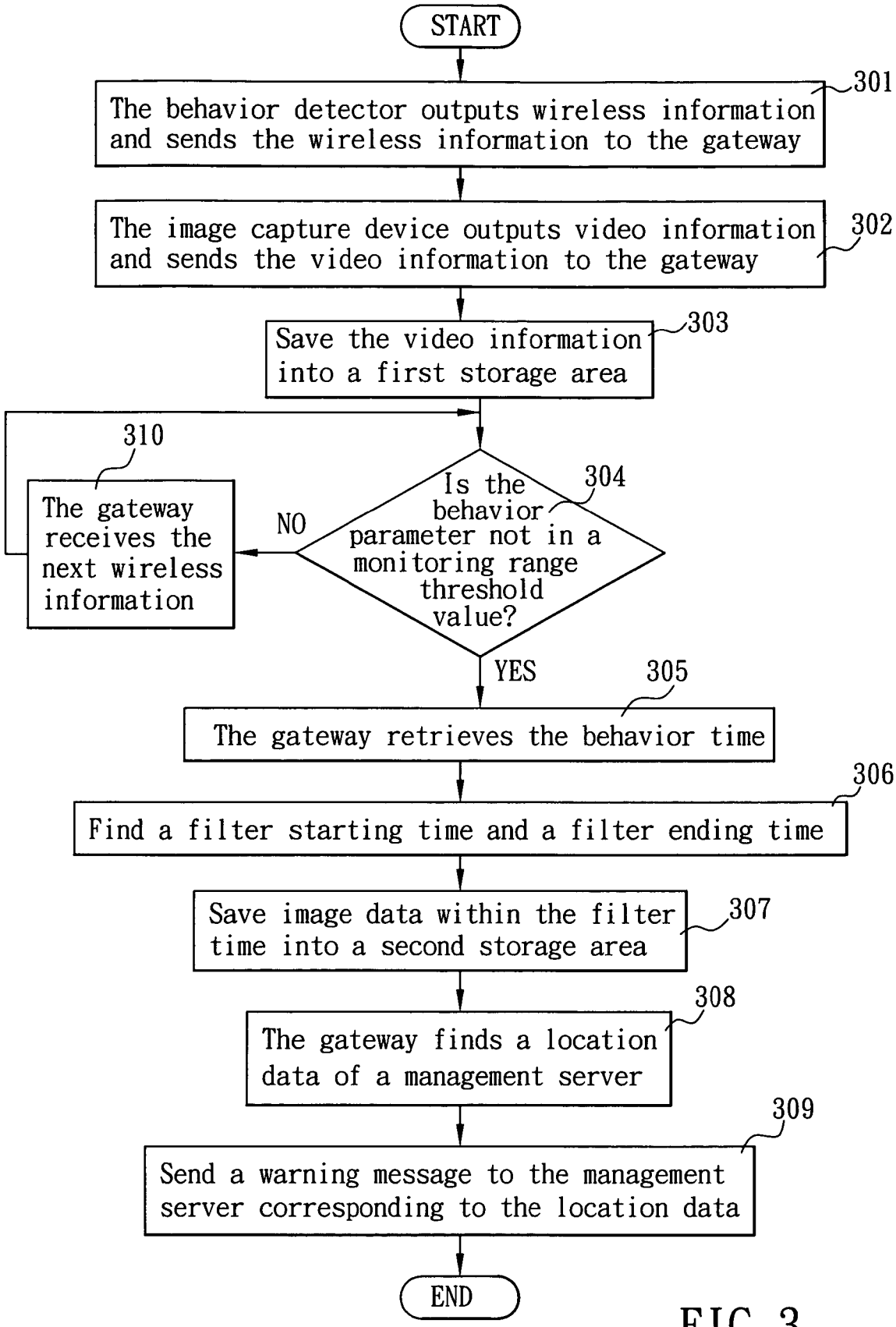
FIG. 3 is a flow chart of the present invention.

A remote homecare monitoring method of the invention is applied in a remote homecare monitoring system, and the system comprises a behavior detector 1 worn on a user who is in a monitoring environment, an image capture device 2 installed at different monitoring areas in the monitoring environment and a gateway 3 installed in the monitoring environment as shown in FIG. 3, and the system processes the following steps:

Step (301): The behavior detector 1 outputs wireless information, and sends the wireless information to the gateway 3. The behavior detector 1 packs a user's behavior parameter based on a detected user's activity behavior, a source identification code stored in the behavior detector 1 and a behavior time produced by the behavior parameter into the wireless information.

Step (302): The image capture device 2 outputs video information, and sends the video information to the gateway 3. The image capture device 2 captures an image data of a scene in the monitoring area and produces a shooting time corresponding to the image data, and packs the image data, an imaging apparatus number stored in the image capture device 2 and the shooting time into video information.

Step (303): The gateway 3 receives the wireless information and video information, and saves the video information into a first storage area of the gateway 3.

Step (304): The gateway 3 determines whether or not the behavior parameter contained in the wireless information lies within a monitoring range threshold value; if yes, then go to Step (305), or else go to Step (310).

Step (305): If the gateway 3 determines that the behavior parameter contained in the wireless information does not lie within the monitoring range threshold value, then the gateway 3 will retrieve a behavior time contained in the wireless information.

Step (306): A filter time of the gateway 3 uses a behavior time corresponding to the behavior parameter as a center to find a filter starting time and a filter ending time.

Step (307); A shooting time contained in the video information is found from the first storage area and an image data in the filter time is found, and all image data in the filter time are saved into a second storage area of the gateway 3.

Step (308): The gateway 3 finds a location data stored in a management server 4 and the location data corresponds to a source identification code contained in the wireless information.

Step (309): The gateway 3 packs the corresponding location data, a source identification code contained in the wireless information, and a network apparatus number stored in the gateway 3 into a warning message, and sends the warning message to a management server 4 corresponding to the location data.

Step (310): If the gateway 3 determines that the behavior parameter contained in the wireless information lies within the monitoring range threshold value, then the gateway 3 will receive the next wireless information, and go to Step (304).

It is noteworthy to point out that when a user uses the system of the invention for the first time, the user must register the following data into a management database of the management server:

1. The source identification code of the behavior detector 1: It refers to an exclusive identification code of the behavior detector 1, which is also a user's exclusive personal identification code;
2. The basic information of a user and the user's related contact person or related medical unit (such as the contact information including a telephone number or an email address of a family member, a doctor or a medical hospital or clinic, etc.): It refers to a source identification code of the behavior detector 1, so that the management server can identify the user and the user's related contact person or related unit of the behavior detector 1 based on the source identification code contained in the warning message;
3. The network apparatus number of the gateway 3: It refers to the exclusive identification code of the gateway 3; and
4. The installation location of the gateway 3 and related contact information (including the address of the contact person or the telephone number or email address of the hospital or clinic nearby: This data refers to a network apparatus number corresponding to the gateway 3 used for facilitating the management server to identify the installation location of the gateway 3 and related contact persons based on the network apparatus number contained in the warning message.

After the management server 4 notices the computer of a related unit or the telephone of a related contact person registered on a management database by a user based on the source identification code contained in the warning message, the computer of the related unit or the telephone of the related contact person will be connected to the gateway 3 via network to obtain all image data within the filter from the second storage area, so as to know about the user's condition when the accident occurs, and provide the most appropriate medical treatment.

In summation of the description above, the computer of a related unit or the telephone of a related contact person can quickly obtain the image data the second storage area before and after (which lies within the filter time) a user becomes unconscious, so as to overcome the shortcomings of conventional remote homecare that can send the physiological parameters to the computer of the related unit or the telephone of the related contact person. Even if the user cannot communicate properly, medical professionals can quickly provide the most appropriate medical treatment based on the image data before and after the user becomes unconscious to overcome the shortcomings of the conventional remote medical service that users cannot communicate with medical professionals when the user is unconscious.

While the invention herein disclosed has been described by means of specific embodiments, numerous modifications and variations could be made thereto by those skilled in the art without departing from the scope and spirit of the invention set forth in the claims.

What is claimed is:

1. A remote homecare monitoring system, comprising:

at least one behavior detector, having a source identification code stored in said behavior detector, for detecting a user's activity behavior, and producing a behavior parameter and a behavior time corresponding to said behavior parameter, and packing said source identification code, behavior parameter and behavior time into wireless information, and sending said wireless information to an external monitoring environment of said behavior detector;

at least one image capture device, having an imaging apparatus number stored in said capturing apparatus, and said capturing apparatus being installed at different monitoring areas in said monitoring environment, for capturing an image data of a scene in said monitoring area, and producing a shooting time of said image data, packing said imaging apparatus number, said image data and said shooting time into video information, and sending said video information to said monitoring environment; and a gateway, installed in said monitoring environment, and having a network apparatus number, a monitoring range threshold value, a filter time and a plurality of location data corresponding to each source identification code stored in said gateway, for continuously receiving said video information sent from said image capture device, and saving said video information into a first storage area in said gateway, and continuously receiving wireless information from said behavior detector, such that if said behavior parameter contained in said wireless information does not lie within said monitoring range threshold value, said filter time bases on said behavior time corresponding to said behavior parameter as a center to calculate a filter starting time, a filter ending time and all image data in said first storage area and corresponding to said video information in the time from said filter starting time to said filter ending time, and saves said image data within said filter time into a second storage area of said gateway, and calculates a location data corresponding to said source identification code in said wireless information, and packs said corresponding location data, said source identification code and said network apparatus number in said wireless information into a warning message, and sends said warning message to a management server corresponding to said location data.

2. The system of claim 1, wherein said behavior detector comprises:

a detection unit, for detecting said user's activity behavior and producing said behavior parameter;

a first storage unit, for storing said source identification code;

a first processor, connected to said detection unit and said first storage unit, for receiving said behavior parameter and said source identification code, and producing a behavior time corresponding to said behavior parameter, and sending out said behavior parameter, said source identification code and said behavior time; and a first wireless transceiver, connected to said first processor, for receiving said behavior parameter, said source identification code and said behavior time from said first processor, and packing said behavior parameter, said source identification code and said behavior time into said wireless information, and sending said wireless information to said monitoring environment.

3. The system of claim 2, wherein said image capture device comprises:

a capture unit, for capturing said image data of a scene in said monitoring area;

a second storage unit, for storing said imaging apparatus number;

a second processor, connected to said capture unit and said second storage unit for receiving said image data and said imaging apparatus number, and producing a shooting time of said image data, and sending said image data, said imaging apparatus number and said shooting time; and a video transmission unit, connected to said second processor, for receiving said image data, said imaging apparatus number and said shooting time from said second processor, and packing said image data, said imaging apparatus number and said shooting time into an image content, and sending said image content to said monitoring environment.

4. The system of claim 3, wherein said gateway comprises:

a second wireless transmitter, for receiving said wireless information;

a monitoring unit, for storing said monitoring range threshold value;

a third storage unit, for storing said network apparatus number;

a video receiver, for receiving said video information;

an image storage unit, comprised of said first storage area and said second storage area;

an image filter, having said filter time;

a report unit, for storing said each location data;

a third processor, connected to said second wireless transmitter, said monitoring unit, said third storage unit, said video receiver, said image storage unit, said image filter and said report unit, such that if said behavior parameter in said wireless information is determined to be not failing within said monitoring range threshold value, the third processor will retrieve said behavior time in said wireless information, and said filter time will base on said behavior time corresponding to said behavior parameter as a center to calculate a filter starting time, a filter ending time, and all image data in said video information and corresponding to said filter time from said filter starting time to said filter ending time, and saves said image data in said filter time into said second storage area, and said report unit finds a location data corresponding to said source identification code in said wireless information and sends out said source identification code and said the network apparatus number in said wireless information; and an information transmitter, connected to said third processor for receiving said location data, said source identification code and said network apparatus number in said wireless information, and packing said source identification code and said network apparatus number in said wireless information as said warning message, and sending said warning message to a management server corresponding to said location data.

5. A remote homecare monitoring method, which is applied in a remote homecare monitoring system, and said system comprises a behavior detector worn by user within a monitoring environment, a plurality of image capture devices installed at different monitoring areas in said monitoring environment and a gateway installed in said monitoring environment, said method comprising the steps of:

said behavior detector outputting wireless information, and sending said wireless information to said gateway;

said image capture device outputting video information, and sending said video information to said gateway;

said gateway receiving said wireless information and said video information, and saving said video information in a first storage area, and determining whether or not said behavior parameter in said wireless information lies within a monitoring range threshold value;

said gateway retrieving a behavior time contained in said wireless information, if said gateway determines that said behavior parameter in said wireless information does not lie within said monitoring range threshold value;

a filter time of said gateway using a behavior time corresponding to said behavior parameter as a center to calculate a filter starting time and a filter ending time;

said gateway further calculating a shooting time in said first storage area and an image contained in said video information within said filter time, and saving said image data within said filter time in a second storage area of said gateway;

said gateway finding a location data stored in a management server of said gateway, and said location data corresponding to a source identification code in said wireless information; and said gateway producing a warning message based on a location data, a source identification code in said wireless information and a network apparatus number stored in said gateway, and sending said warning message to a management server corresponding to said location data.

6. The method of claim 5, wherein said behavior detector saves said user's behavior parameter corresponding to a detected user's activity behavior, and packs a source identification code stored in said behavior detector and a behavior time corresponding to said behavior parameter into said wireless information.

7. The method of claim 5, wherein said image capture device captures an image data of a scene in said monitoring area, and produces a shooting time corresponding to said image data, and saves said image data, and packs said imaging apparatus number and said shooting time stored in said image capture device into said video information.

* * * * *